US006697593B2

(12) United States Patent
Imamura et al.

(10) Patent No.: US 6,697,593 B2
(45) Date of Patent: Feb. 24, 2004

(54) DEVELOPING DEVICE USING A DEVELOPING ROLLER AND IMAGE FORMING APPARATUS INCLUDING THE SAME

(75) Inventors: Tsuyoshi Imamura, Sagamihara (JP); Sumio Kamoi, Tokyo (JP); Kyota Koetsuka, Fujisawa (JP); Noriyuki Kamiya, Atsugi (JP); Mieko Kakegawa, Atsugi (JP); Toshihiro Atsumi, Atsugi (JP)

(73) Assignee: Ricoh Company, Ltd., Tokyo (JP)

( * ) Notice: Subject to any disclaimer, the term of this patent is extended or adjusted under 35 U.S.C. 154(b) by 155 days.

(21) Appl. No.: 10/078,343

(22) Filed: Feb. 21, 2002

(65) Prior Publication Data

US 2002/0114647 A1 Aug. 22, 2002

(30) Foreign Application Priority Data

Feb. 22, 2001 (JP) ..... 2001-047095

(51) Int. Cl.[7] ..... G03G 15/09

(52) U.S. Cl. ..... 399/267; 399/277; 492/18; 492/59

(58) Field of Search ..... 399/267, 277, 399/276; 492/18, 52, 53, 59; 430/122

(56) References Cited

U.S. PATENT DOCUMENTS

| | | | | |
|---|---|---|---|---|
| 4,389,972 | A | 6/1983 | Hirakura et al. | 399/277 |
| 4,461,562 | A | 7/1984 | Goldfinch | 399/277 |
| 5,075,729 | A | 12/1991 | Hayashi et al. | 399/267 |
| 5,244,741 | A | 9/1993 | Nagano et al. | |
| 5,529,628 | A | 6/1996 | Fuchiwaki et al. | 399/276 |
| 5,574,546 | A | 11/1996 | Kumasaka et al. | 399/276 |
| 5,634,183 | A | 5/1997 | Saito et al. | 399/277 |
| 5,970,294 | A | 10/1999 | Narita et al. | |
| 6,070,038 | A | 5/2000 | Imamura et al. | |
| 6,112,042 | A | 8/2000 | Imamura et al. | |
| 6,125,255 | A | 9/2000 | Litman et al. | 399/277 |
| 6,198,895 | B1 | 3/2001 | Tsuda et al. | |
| 6,287,246 | B1 | 9/2001 | Yoshii et al. | |
| 6,330,415 | B1 | 12/2001 | Imamura et al. | |
| 6,337,957 | B1 | 1/2002 | Tamaki et al. | |
| 6,421,519 | B1 | 7/2002 | Yamashita et al. | 399/277 |

FOREIGN PATENT DOCUMENTS

| | | | |
|---|---|---|---|
| JP | 09006137 A | 1/1997 | G03G/15/09 |
| JP | 2000-81789 | 3/2000 | |
| JP | 2000068120 A | 3/2000 | G03G/15/09 |
| JP | 2000-323322 | 11/2000 | |

OTHER PUBLICATIONS

U.S. patent application Ser. No. 10/078,343 Imamura et al, filed Feb. 21, 2002.

U.S. patent application Ser. No. 10/440,108 Imamura et al, filed May 19, 2003.

*Primary Examiner*—Susan S. Y. Lee

(74) *Attorney, Agent, or Firm*—Oblon, Spivak, McClelland, Maier & Neustadt, P.C.

(57) ABSTRACT

A developing roller of the present invention is made up of a nonmagnetic sleeve and a magnet roller disposed in the sleeve. The magnet roller includes a cylindrical magnet produced by molding a mixture of magnetic powder and a high polymer, and a single rare-earth magnet block mounted on the magnet at a position corresponding to a main magnetic pole for development. The cylindrical magnet is magnetized such that magnetic poles adjoining the main magnetic pole are opposite in polarity to the main pole. The main pole and each pole adjoining it make an angle of 45° or less therebetween.

6 Claims, 7 Drawing Sheets

DEVELOPING DEVICE USING A DEVELOPING ROLLER AND IMAGE FORMING APPARATUS INCLUDING THE SAME

BACKGROUND OF THE INVENTION

1. Field of the Invention

The present invention relates to a copier, printer, facsimile apparatus or similar image forming apparatus and more particularly to a developing device included in such an image forming apparatus and a developing roller for the developing device.

2. Description of the Background Art

It is a common practice with an electrophotographic image forming process to use a two-ingredient type developer, which is a toner and carrier mixture. The developer deposits on a developer carrier in the form of a magnet brush and contacts an image carrier on which a latent image is formed. A bias for development is applied to the developer carrier, forming an electric field between the image carrier and the developer carrier. As a result, the toner of the developer is selectively transferred from the developer carrier to the image carrier, developing the latent image.

The developer carrier is generally implemented as a sleeve accommodating a magnet roller therein. The magnet roller forms a magnetic field for causing the developer to rise in the form of a magnet brush on the sleeve. More specifically, the carrier of the developer rises on the sleeve along the magnetic lines of force issuing from the magnet roller, forming brush chains. The toner, which is charged beforehand, deposits on the brush chains to thereby form a magnet brush. The magnet roller has a plurality of magnetic poles implemented by a rod-like or similar magnet each. Among them, a main pole for development is positioned in a developing zone for causing the developer to rise on the sleeve.

At least one of the sleeve and magnet roller moves to convey the developer risen on the sleeve to the developing zone. In the developing zone, the developer rises along the magnetic lines of force issuing from the main pole, forming brush chains. The brush chains contact the image carrier while yielding. While the brush chains rub themselves against the latent image on the basis of a difference in linear velocity between the developer carrier and the image carrier, the toner is fed from the developer to the latent image. The developing zone refers to a range over which the magnet brush risen on the developer carrier contacts the latent image.

The problem with the conventional developing device using a magnet brush is that an image forming condition for increasing image density and an image forming condition for desirably reproducing a low-contrast image are not compatible with each other. It is therefore difficult to improve both of a high density portion and a low density portion at the same time. More specifically, a high image density is attainable if, e.g., a gap between the image carrier and the sleeve is reduced or if the developing zone is broadened in width. On the other hand, a low-contrast image can be desirably reproduced if, e.g., the above gap is increased or if the developing zone is narrowed. It follows that it is difficult to satisfy such contradictory conditions at the same time over the entire image density range.

For example, when importance is attached to the reproduction of a low-contrast image, the trailing edge of a black solid image or that of a halftone solid image is lost. This is also true with the crossing portions of solid lines. Other defects apt to occur are that a horizontal line originally identical in width with a vertical line appears thinner than the vertical line when developed, and that solitary dots are not developed at all.

Japanese Patent Laid-Open Publication No. 2000-29637, for example, discloses a method and an apparatus for development configured to implement high image quality over the entire density range by satisfying the contradictory conditions at a high level. However, a problem with this method and apparatus is that the main pole of a developing roller has a smaller angle between poles than the conventional developing roller, resulting in the need for magnets with high magnetic characteristics. Moreover, the main pole must be provided with accuracy of ±1° that is higher than the conventional accuracy of ±2°. For high magnetic characteristics, the main pole of the developing roller is often implemented by Ne—Fe—B or similar so-called rare-earth magnets. However, rare-earth magnets are generally more expensive than ferrite magnets and therefore increase the cost of the developing roller.

Technologies relating to the present invention are also disclosed in, e.g., Japanese Patent Laid-Open Publication Nos. 2000-81789 and 2000-323322.

SUMMARY OF THE INVENTION

It is an object of the present invention to provide a low-cost developing roller easy to produce and having high magnetic characteristics and an accurate main pole, a developing device insuring high image quality over the entire density range with the developing roller, and an image forming apparatus including the developing device.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
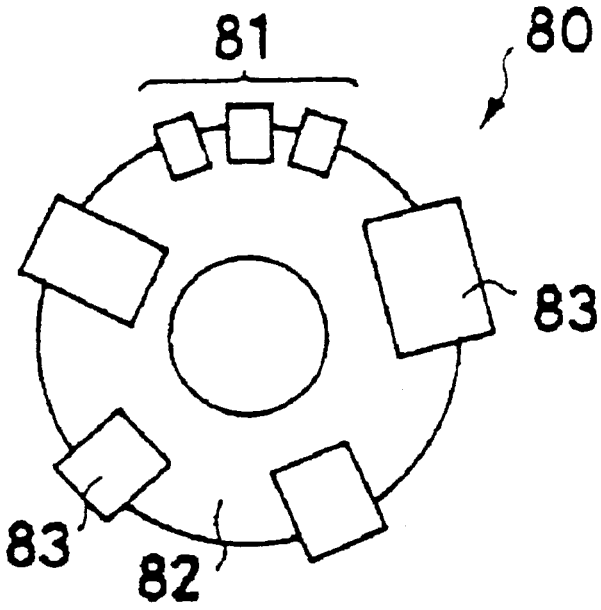
FIG. 1 PRIOR ART
FIG. 1 is a section showing a conventional magnet roller.

To better understand the present invention, brief reference will be made to a conventional developing roller, shown in FIG. 1. The developing roller to be described includes a main pole portion implemented as Ne—Fe—B or similar rare-earth magnets for achieving high magnetic characteristics. As shown, the developing roller, generally 80, includes a nonmagnetic holder 82 with a core molded integrally therewith. Three rare-earth magnet blocks 81 forming a main pole for development and a plurality of ferrite blocks 83 forming the other poles are adhered to the holder 82. The developing roller 80 is disposed in a sleeve not shown. This kind of developing roller 80, however, cannot be constructed unless it has a great diameter.

Figure 2:
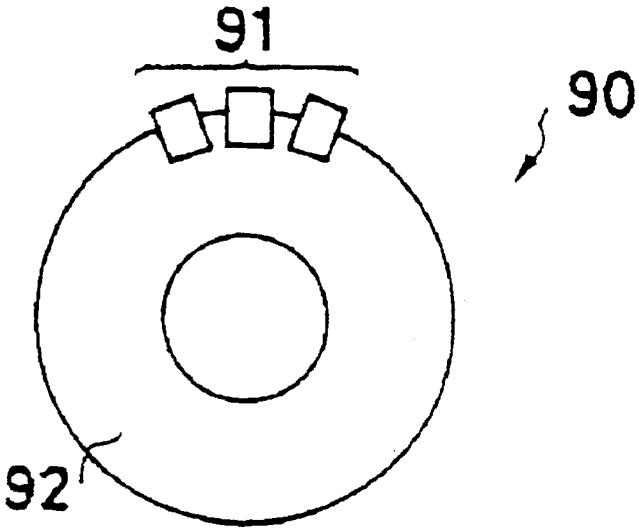
FIG. 2 PRIOR ART
FIG. 2 is a section showing another conventional magnet roller.

FIG. 2 shows another conventional developing roller made up of a magnet roller 90 and a sleeve, not shown, accommodating the magnet roller 90. As shown, the magnet roller 90 has a magnet roll 92 implemented as a cylindrical, ferrite-based plastic magnet. Magnet pieces 91 with high magnetic characteristics are adhered only to the portion of the magnet roll 92 expected to form a main pole for development. This configuration is advantageous over the configuration of FIG. 1 as to the problem stated above. The magnet roller 90, however, increases the number of production steps with an increase in the number of magnet pieces or blocks 91, resulting in high production cost. Moreover, the magnet roller 90 is expensive because rare-earth magnets are generally more expensive than ferrite magnets.

Figure 3:
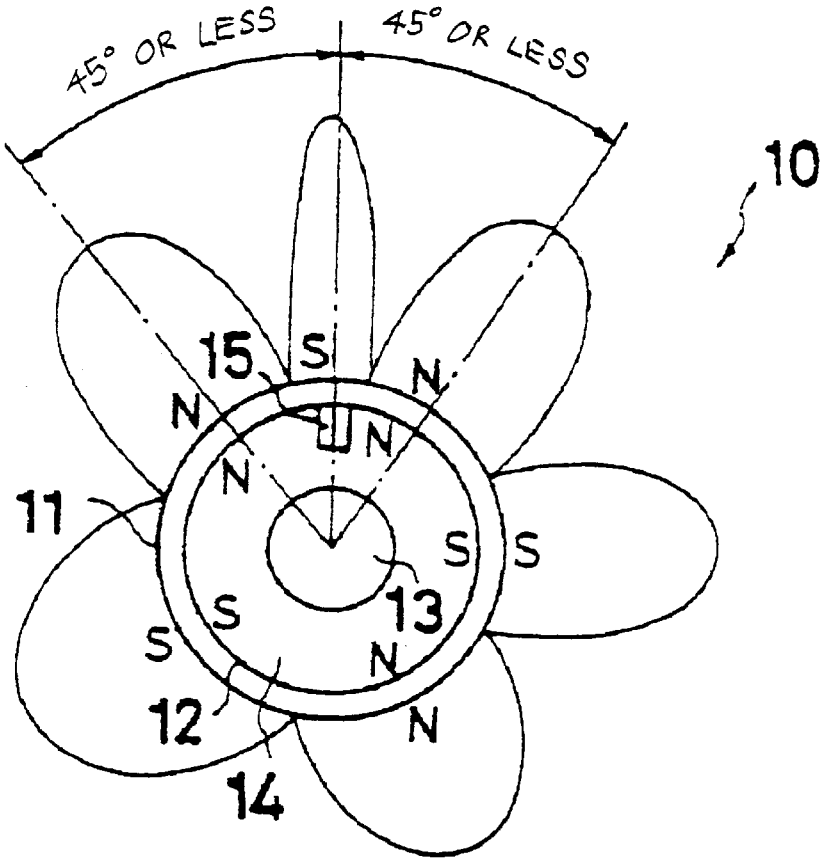
FIG. 3 is a section showing a developing roller embodying the present invention together with a magnetic waveform thereof.

Referring to FIG. 3, a developing roller embodying the present invention will be described. As shown, the developing roller, generally 10, is made up of a magnet roller 12 and a nonmagnetic cylindrical sleeve 11 accommodating the magnet roller 12 therein. The magnet roller 12 is made up of a core 13 and a hollow cylindrical magnet 14. The cylindrical magnet 14 is formed with a groove extending in the axial direction of the magnet 14. An elongate, rare-earth magnet block 15 is received in the above groove and implemented as a rod. In the illustrative embodiment, the magnet roller 12 is fixed in place while the sleeve 11 is rotatable.

The magnet 14 implements magnetic characteristics other than a main pole for development. The magnet 14 is, in many cases, formed of plastics or rubber containing magnetic power in which a high polymer is mixed. For the magnetic powder, use maybe made of Sr ferrite or Ba ferrite. For the high polymer, use may be made of 6PA, 12PA or similar PA (polyamide), EEA (ethylene-ethyl copolymer), EVA (ethylene-vinyl copolymer) or similar ethylene compound, CPE (chlorinated polyethylene) or similar chlorine-based substance or NBR (acrylonitrile butadiene) or similar rubber.

The magnet block 15, which forms the main pole, should preferably have a flux density greater than 0.5 T (tesla) so as to have a narrow, high magnetic characteristic. The magnet block 15 may be implemented as an Ne—Fe—B or similar Ne-based rare-earth magnet or an Sm—Co, Sm—Fe—N or similar rare-earth magnet. Alternatively, the magnet block 15 may be implemented as a plastic magnet or a rubber magnet formed of the above magnet powder in which the previously mentioned high polymer is mixed.

In the illustrative embodiment, the magnet 14 forms magnetic poles other than the main pole, i.e., scooping and conveying magnetic poles. Specifically, the magnet 14 has the main pole (S pole formed by the magnet block 15) and auxiliary poles (N poles) positioned at both sides of the main pole. Each auxiliary pole and the main pole make an angle of 45° or less therebetween, as shown in FIG. 3. This provides the main pole with a high magnetic characteristic and high accuracy despite that the main pole is formed by a single rare-earth magnet block. Further, the single rare-earth magnet block forming the main pole allows the diameter and cost of the developing roller to be reduced and reduces an increase in cost ascribable to the rare-earth magnet block. If the angle between the main pole and the adjoining auxiliary pole is greater than 45°, then the magnetic force of the main pole is apt to become too weak to realize a required magnetic characteristic, while aggravating carrier deposition and other defects.

The magnet block 15 and magnet 14 may be connected together by adhesive. Alternatively, use may be made of a method using ultrasonic oscillation, depending on the material.

Assume that the main pole has a half width of 20° or below. The half width refers to an angular range between points where the magnetic force is one half of the maximum or peak magnetic force of the magnetic force distribution curve in the normal direction. Then, when the developing roller has a diameter of 16 mm to 20 mm, the sleeve surface should have a flux density of 80 mT to 90 mT, as will be described in relation to a developing device later. It follows that the magnet forming the main pole should have a width not exceeding 2 mm and a height not exceeding about 3 mm. In such a case, the magnet block 15 should preferably have a flux density Br greater than 0.5 T.

Figure 4:
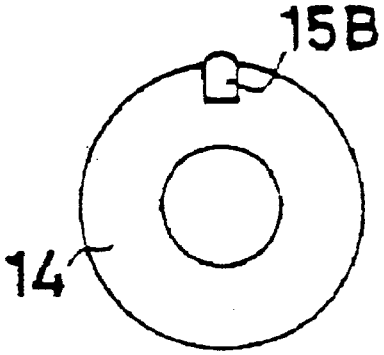
FIG. 4 is a fragmentary section showing a modification of a magnet block included in the illustrative embodiment.

FIG. 4 shows a modified form of the magnet block 15B. As shown, a magnet block 15B has opposite shoulders, which adjoin the sleeve 11, rounded for reducing the distance between the magnet block and the sleeve 11. This configuration successfully increases the flux density of the main pole. More specifically, the rare-earth magnet block 15B with the rounded shoulders does not contact the sleeve 11 even when the above distance is reduced, so that the distance between the block 15B and the sleeve 11 can be reduced. Consequently, even when the magnetic characteristic of the magnet block 15B is low, a characteristic necessary for high quality images is achievable over the entire image density range.

Figure 5:
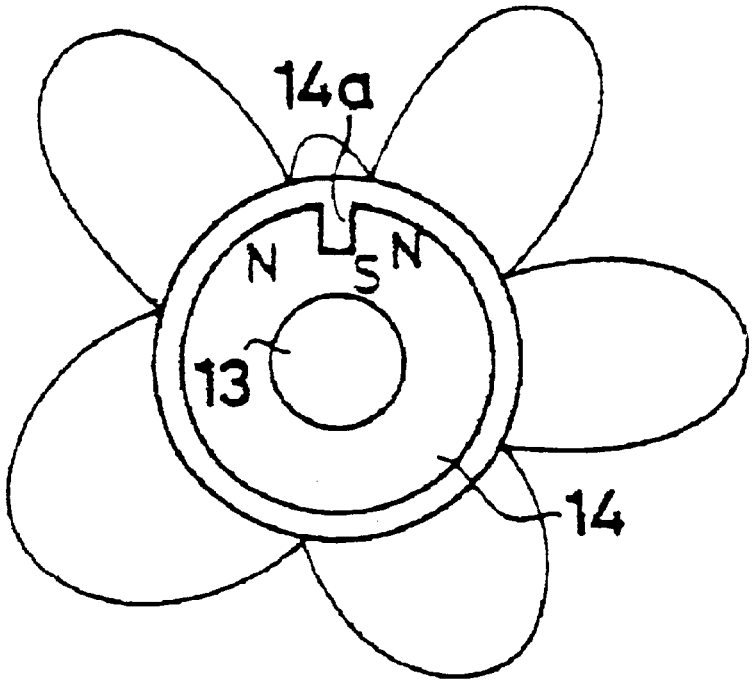
FIG. 5 shows the magnetic characteristics of a cylindrical magnet also included in the illustrative embodiment for describing a specific method of producing the developing roller.
Figure 6:
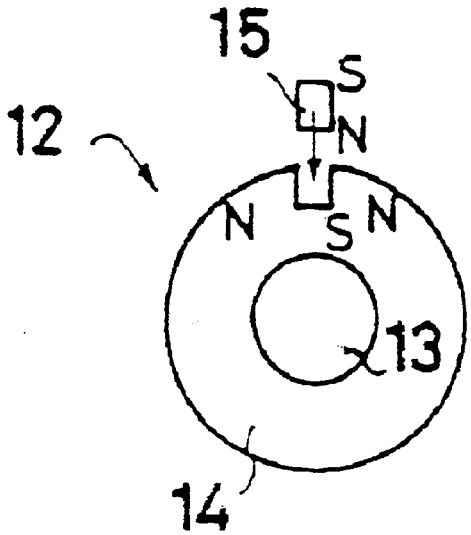
FIG. 6 shows how the magnet block is adhered to the cylindrical magnet.
Figure 7:
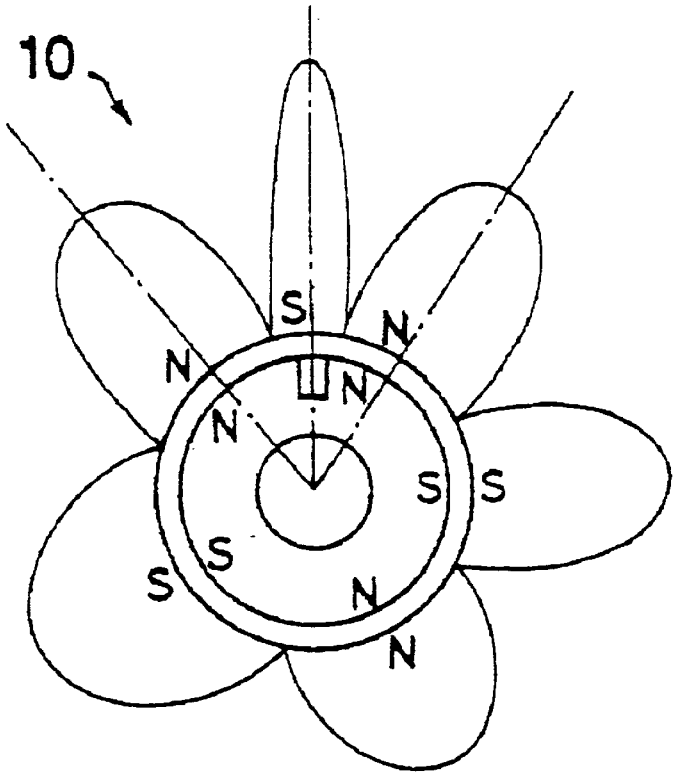
FIG. 7 shows the magnetic waveform of the developing roller attainable after the adhesion of the magnet block.

Reference will be made to FIGS. 5 through 7 for describing a method of producing the magnet roller 12. As shown, the hollow cylindrical magnet 14 formed with a groove 14*a* for receiving the magnet block 15 (or 15B) is produced by extrusion molding or injection molding. Subsequently, the core 13 is inserted into the magnet 14. At this instant, the reference surface (milled surface in many cases) of the core 13 and the groove 14*a* of the magnet 14 are fixed in place by a jig. The core 13 is then inserted into the magnet 14 such that the reference surface and groove 14*a* make a desired angle therebetween. This allows the magnet block 15 to be accurately positioned relative to the reference surface when it is adhered to the magnet 14. Such accurate positioning insures the accurate position of the main pole.

During molding of the magnet 14, a magnetic field should preferably be applied for enhancing the magnetic characteristics of the resulting magnet roller 12. The magnetic field makes the magnetic powder (Sr ferrite or Ba ferrite in many cases) anisotropic.

Subsequently, as shown in FIG. 5, the magnet 14 is so magnetized as to have the desired magnetic characteristics.

Magnetization is effected such that the portions of the magnet 14 expected to adjoin the magnet block 15 are opposite in polarity to the magnet block 15. In the illustrative embodiment, the portions of the magnet 14 sandwiching the groove 14*a* are magnetized to N polarity because the main pole is an S pole. Further, the portion of the magnet 14 where the groove 14*a* is positioned is also magnetized to S polarity.

Thereafter, as shown in FIG. 6, the magnet block 15 is inserted in and adhered to the walls of the groove 14*a*. At this instant, the walls of the groove 14*a* attract the magnet block 15 for thereby accurately positioning the block 15. In addition, the flux density of the main pole is increased after the adhesion of the magnet block 15 to the walls of the groove 14*a*, as shown in FIG. 7. This is because the flux density of the main pole can be regarded as the sum of the flux density of the portion of the magnet 14 corresponding to the magnet block 15 and the flux density of the magnet block 15.

In the illustrative embodiment, because the main pole S is an S pole, the magnet block 15 is adhered to the walls of the groove 14*a* with its N side facing the magnet 14. Therefore, the N pole of the magnet block 15 and the S pole of the groove 14*a* attract each other.

Figure 8:
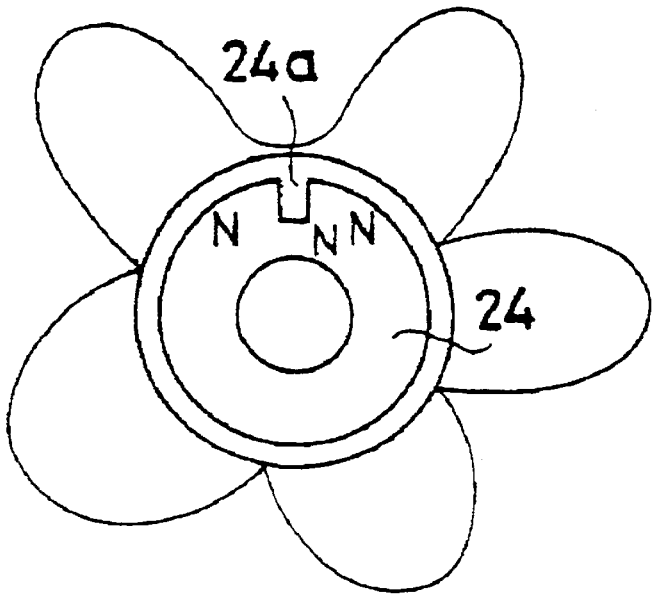
FIG. 8 shows the magnetic characteristics of a comparative cylindrical magnet.
Figure 9:
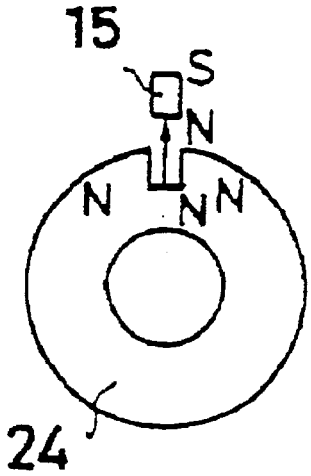
FIG. 9 shows how a magnet block is adhered to the comparative cylindrical magnet.
Figure 10:
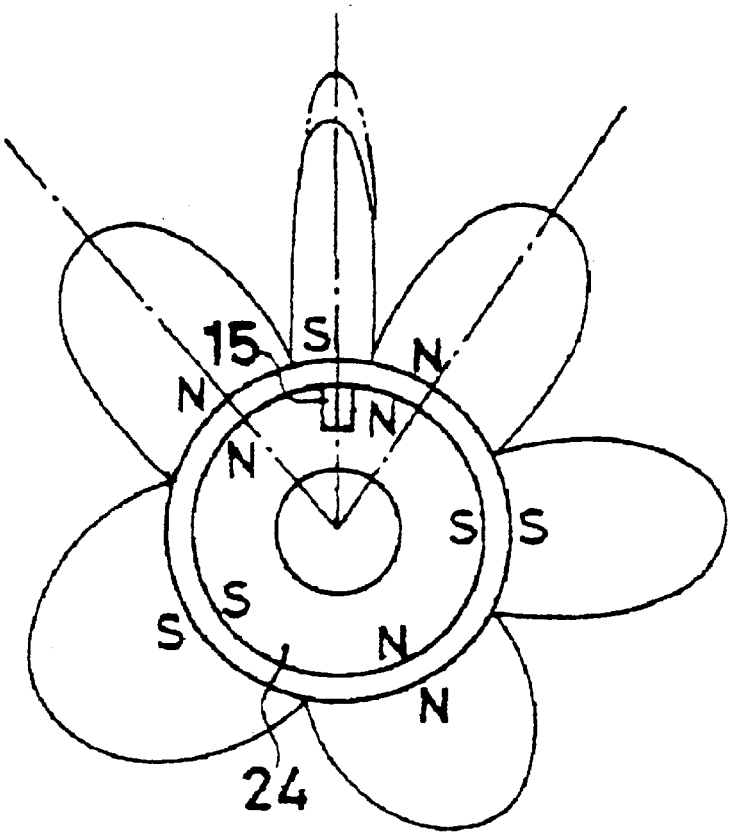
FIG. 10 shows the magnetic waveform of a developing roller to which the comparative cylindrical magnet is applied.

FIGS. 8 through 10 compare the illustrative embodiment and a comparative developing roller. FIG. 8 shows the comparative developing roller including a cylindrical magnet 24 formed with a groove 24*a*. As shown, the walls of the groove 24*a* corresponding to the magnet block 15 have the same polarity as the adjoining poles, i.e., N polarity. In this configuration, as shown in FIG. 9, the magnet block 15 and magnet 24 repulse each other when the former is to be adhered to the latter. It is therefore difficult to accurately position the magnet block 15. Moreover, as shown in FIG. 10, the flux density of the main pole is low after the adhesion of the magnet block 15, as indicated by a solid line in FIG. 10.

Figure 11:
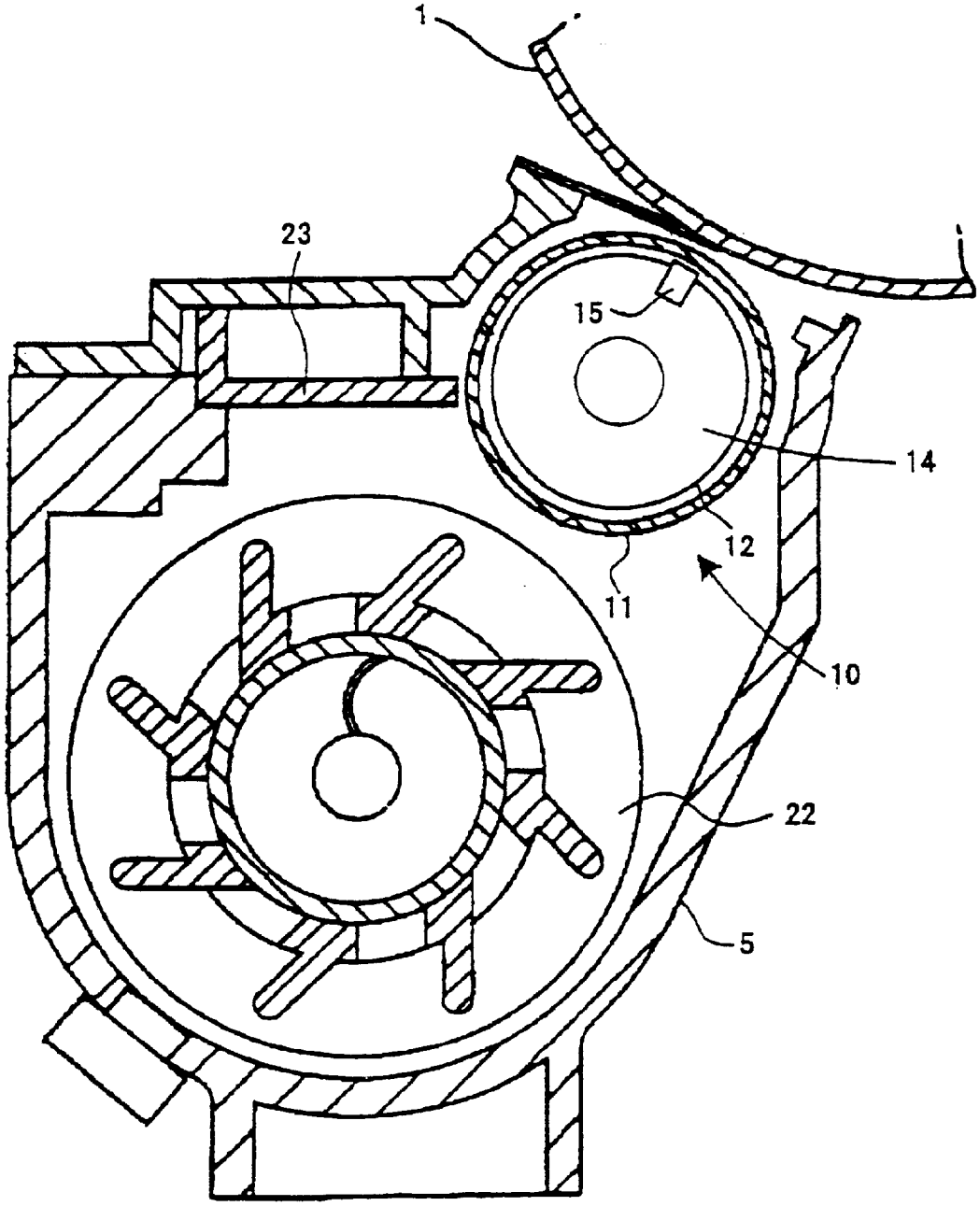
FIG. 11 is a section showing a developing device including the developing roller of the illustrative embodiment.

FIG. 11 shows a developing device 5 including the developing roller 10 of the illustrative embodiment. As shown, the developing roller, which plays the role of a developer carrier, 10 is positioned in the vicinity of a photoconductive drum or image carrier 1 included in an image forming apparatus. A developing zone is formed between the developing roller 10 and the drum 1. The sleeve 11 accommodating the magnet roller 12 is formed of aluminum, brass, stainless steel, conductive resin or similar nonmagnetic material. A mechanism, not shown, causes the sleeve 11 to rotate clockwise, as viewed in FIG. 11. In the illustrative embodiment, a gap for development between the drum 1 and the sleeve 11 is selected to be 0.4 mm.

A doctor blade or metering member 23 is positioned upstream of the developing zone in the direction in which the sleeve 11 conveys a developer (clockwise). The doctor blade 23 regulates the amount of the developer, i.e., the height of brush chains formed on the sleeve 11. In the illustrative embodiment, a doctor gap of 0.4 mm is formed between the doctor blade 23 and the sleeve 11. A screw 22 is positioned at the opposite side to the drum 1 with respect to the sleeve 11 for scooping up the developer stored in a casing to the sleeve 11.

The magnet roller 12, which is fixed in place, causes the developer to form brush chains or magnet brush on the circumference of the sleeve 11. The magnet roller 11 is made up of the ferrite magnet 14 and rare-earth magnet block 15, as stated earlier. To provide the main pole with a half width of 20° or below and a flux density of 80 mT or above, the magnet block 15 is formed of anisotropic Nd—Fe—B or anisotropic Sm—Fe—N. Carrier grains, which form part of the developer, rise on the sleeve 11 in the form of brush chains along the magnetic lines of force issuing from the magnet roller 12 in the normal direction. Charged toner grains, which forms the other part of the developer, deposit on the brush chains, forming the magnet brush. The sleeve 11 in rotation conveys the magnet brush in the same direction (clockwise as viewed in FIG. 11).

The main pole has a half width of 20° or below and a flux density of 80 mT or above, as stated above. The main pole with such a high magnetic characteristic insures attractive images over the entire image density range. The developing roller 10 realizes such a magnetic characteristic and the accurate main pole at lost cost.

Figure 12:
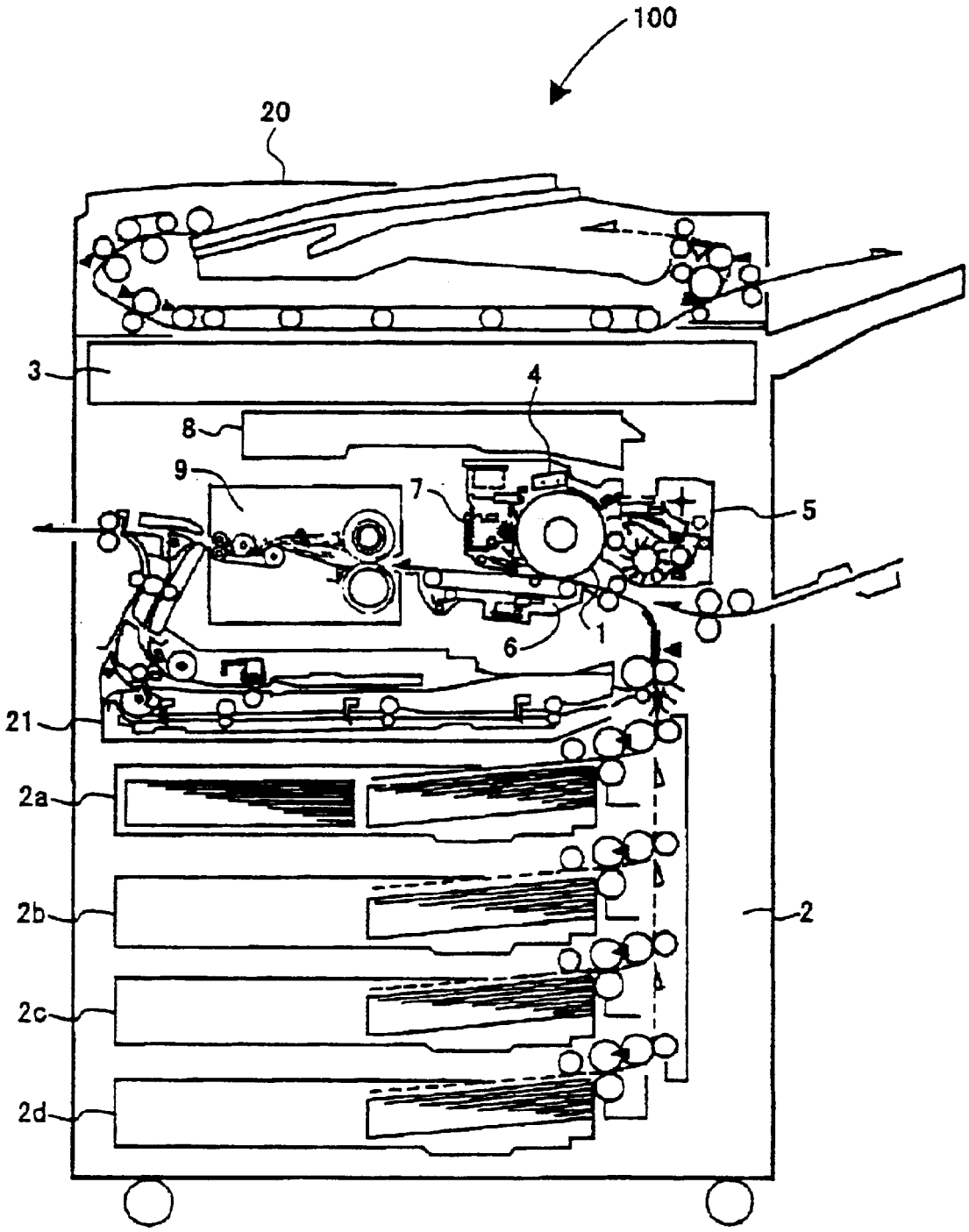
FIG. 12 is a view showing an image forming apparatus including the developing device of FIG. 11.

FIG. 12 shows an image forming apparatus to which the developing device 5 is applied. The image forming apparatus is implemented as a copier by way of example. As shown, the copier, generally 100, has the drum 1 substantially at its center. Process units for image formation are arranged around the drum 1. A sheet feeding section 2 is positioned below the process units and includes four sheet trays 2*a* through 2*d* arranged one above the other. A scanner 3 is positioned above the process units for reading a document. An ADF (Automatic Document Feeder) 20 is mounted on the top of the copier.

The process units around the drum 1 include a charger 4, an image transfer and conveyance unit 6 and a drum cleaner 7 as well as the developing device 5. An optical writing unit 8 is positioned between such process units and the scanner 3. A laser beam issuing from the optical writing unit 7 scans the drum 1 at a position between the charger 4 and the developing device 5. A fixing unit 9 is positioned at the left-hand side of the drum cleaner 7, as viewed in FIG. 12. A duplex copy tray 21 is arranged below the fixing unit 9.

In operation, the charger 4 uniformly charges the surface of the drum 4. The optical writing unit 7 scans the charged surface of the drum 4 with the laser beam in accordance with image data to thereby form a latent image on the drum 4. The developing device 4 develops the latent image with the developer for thereby producing a corresponding toner image. The image transfer and conveyance unit 5, which includes a belt, transfers the toner image from the drum 1 to a sheet or recording medium fed form the sheet feeding section 2. The unit 5 then conveys the sheet to the fixing unit 9. The fixing unit 9 fixes the toner image on the sheet. The drum cleaner 7 removes the toner left on the drum 1 after the image transfer. Discharging means, not shown, discharges the cleaned surface of the drum 1 to thereby prepare it for the next image formation. The sheet with the fixed toner image is driven out to a copy tray not shown. In a duplex copy mode, the sheet carrying the fixed toner image on one side thereof is conveyed to the duplex copy tray 21 and again fed to the image forming section. After a toner image has been formed on the other side of the sheet, the sheet is driven out to the copy tray.

It is to be noted that the polarities of the magnet roller shown and described are only illustrative and may be reversed. The portions of the developing device other than the developing roller may, of course, be suitably modified. This is also true with the image forming apparatus including the developing device.

In summary, in accordance with the present invention, a magnet roller has only one main pole for development, and yet provides the main pole with a high magnetic characteristic and high accuracy. The magnet roller therefore implements a simple, low-cost developing roller that insures attractive images over the entire image density range. In addition, attractive images are achievable over the entire image density range even when the magnetic characteristic of a magnet block is low, because the distance between the magnet block and a sleeve can be reduced.

Further, the magnet block can be accurately positioned relative to a cylindrical magnet. The pole of the magnet block and the pole of the cylindrical magnet corresponding in position to each other increase the flux density of the main pole. This also insures attractive images over the entire image density range. Moreover, the magnet block can be accurately positioned relative to a core, providing the main pole with high angular accuracy.

Various modifications will become possible for those skilled in the art after receiving the teachings of the present disclosure without departing from the scope thereof.

What is claimed is:

1. A developing roller comprising:

a sleeve formed of a nonmagnetic material; and a magnet roller disposed in said sleeve;

said magnet roller comprising:

a cylindrical magnet produced by molding a mixture of magnetic powder and a high polymer; and a single rare-earth magnet block mounted on said cylindrical magnet at a position corresponding to a main magnetic pole for development;

wherein said cylindrical magnet is magnetized such that magnetic poles adjoining said main magnetic pole are opposite in polarity to said main magnetic pole, and the main magnetic pole and each of said magnetic poles adjoining said main magnetic pole make an angle of 45° or less therebetween.

2. The developing roller as claimed in claim 1, wherein said magnet block has opposite shoulders, which adjoin a circumference of said cylindrical magnet, rounded.

3. In a developing device for depositing a developer on a developing roller in a form of a magnet brush and causing said magnet brush to contact a latent image formed on an image carrier to thereby develop said latent image, said developing roller comprising:

a sleeve formed of a nonmagnetic material and on which the developer deposits in the form of the magnet brush; and a magnet roller disposed in said sleeve;

said magnet roller comprising:

a cylindrical magnet produced by molding a mixture of magnetic powder and a high polymer; and a single rare-earth magnet block mounted on said cylindrical magnet at a position corresponding to a main magnetic pole for development;

wherein said cylindrical magnet is magnetized such that magnetic poles adjoining said main magnetic pole are opposite in polarity to said main magnetic pole, and the main magnetic pole and each of said magnetic poles adjoining said main magnetic pole make an angle of 45° or less therebetween.

4. In an image forming apparatus including a developing device for depositing a developer on a developing roller in a form of a magnet brush and causing said magnet brush to contact a latent image formed on an image carrier to thereby develop said latent image, said developing roller comprising:

a sleeve formed of a nonmagnetic material and on which the developer deposits in the form of the magnet brush; and a magnet roller disposed in said sleeve;

said magnet roller comprising:

a cylindrical magnet produced by molding a mixture of magnetic powder and a high polymer; and a single rare-earth magnet block mounted on said cylindrical magnet at a position corresponding to a main magnetic pole for development;

wherein said cylindrical magnet is magnetized such that magnetic poles adjoining said main magnetic pole are opposite in polarity to said main magnetic pole, and the main magnetic pole and each of said magnetic poles adjoining said main magnetic pole make an angle of 45° or less therebetween.

5. A method of producing a developing roller comprising a sleeve formed of a nonmagnetic material and a magnet roller disposed in said sleeve, said method comprising the steps of:

molding a cylindrical magnet from a mixture of magnetic powder and a high polymer;

magnetizing said cylindrical magnet such that a portion of said cylindrical magnet to which a magnet block expected to form a main magnetic pole for development is to be adhered is of a same polarity as said main magnetic pole and such that magnetic poles expected to adjoin said main magnetic pole are opposite in polarity to said main magnetic pole;

adhering said magnet block to said cylindrical magnet magnetized to thereby constitute the magnet roller; and disposing said magnet roller in the sleeve.

6. The method as claimed in claim 5, further comprising the steps of:

forming, when molding said cylindrical magnet, an axial groove in a surface of said cylindrical magnet for receiving said magnet block;

inserting a core into said cylindrical magnet such that said groove and a reference surface of said core make a preselected angle therebetween; and positioning said magnet block in said groove after magnetization of said cylindrical magnet.

* * * * *